US005253456A

United States Patent [19]

Todd

[11] Patent Number: 5,253,456

[45] Date of Patent: Oct. 19, 1993

[54] ENDCAP FOR RAIN GUTTERS

[75] Inventor: James A. Todd, Gadsden, Ala.

[73] Assignee: RainGard of Alabama, Inc., Rainbow City, Ala.

[21] Appl. No.: 851,965

[22] Filed: Mar. 16, 1992

[51] Int. Cl.[5] ..... E04D 13/06

[52] U.S. Cl. ..... 52/11

[58] Field of Search ..... 52/11, 12, 15, 16; 248/48.1; 210/474

[56] References Cited

U.S. PATENT DOCUMENTS

| | | | |
|---|---|---|---|
| 190,382 | 5/1877 | Snyder | 52/11 X |
| 3,545,144 | 12/1970 | Sickler | 52/11 |
| 3,616,582 | 11/1971 | Walek et al. | 52/16 X |
| 3,834,091 | 10/1974 | Dugan | 52/12 |
| 4,190,988 | 3/1980 | Carreiro | 52/16 |
| 4,418,504 | 12/1983 | Lassiter | 52/12 |
| 4,604,837 | 8/1986 | Beam | 52/12 |
| 4,714,136 | 12/1987 | Morin | 52/11 X |
| 4,765,101 | 8/1988 | Wolf | 52/12 |
| 4,998,386 | 3/1991 | Baumgarth | 52/11 X |

FOREIGN PATENT DOCUMENTS

| | | | |
|---|---|---|---|
| 0992712 | 5/1965 | United Kingdom | 52/11 |

*Primary Examiner*—Carl D. Friedman
*Assistant Examiner*—Robert Canfield
*Attorney, Agent, or Firm*—Veal & Associates

[57] ABSTRACT

An improvement in endcaps for use with a rain gutter, the improvement having an endcap defining an end wall that extends diagonally upwardly from the rain gutter past the longitudinal extension of the fascia board to which the rain gutter is connected and beneath a portion of the shingles extending beyond the fascia board. The extended endcap receives runoff water falling from the aforesaid portion of the shingles and conducts the runoff water within the rain gutter.

8 Claims, 4 Drawing Sheets

ENDCAP FOR RAIN GUTTERS

FIELD OF THE INVENTION

The present invention relates to rain gutters and more particularly to endcaps for enclosing the end of an elongated rain gutter.

BACKGROUND OF THE INVENTION

The use of an elongated trough or gutter for capturing rainwater flowing from a shingled roof is well known in the roofing industry. Such gutters are normally connected to a fascia board which defines a lower portion of a shingle support structure. The plurality of shingles are typically laid on the shingle support structure in such a manner that the shingles extend laterally a predetermined distance past the fascia board and over the rain gutter. As shown in FIG. 1, the plurality of shingles also extend longitudinally a predetermined distance beyond the end of the fascia board. A trim piece is sometimes connected to the fascia board subjacent the shingles. The shingles extend a predetermined distance past the trim piece and thus an even greater distance from the end of the fascia board As shown in FIG. 1, the rain gutter is typically connected to the fascia board and does not extend past the end thereof.

Commonly, an endcap is connected to the rain gutter to enclose the end thereof. The endcaps typically define a vertical face extending adjacent to the end of the rain gutter; thus the endcap does not extend beyond the end of the fascia board. The resultant effect of such rain gutter/endcap arrangements is that water flows from the portion of the shingles extending longitudinally beyond the end of the fascia board and falls past the gutter and endcap and to the ground below, thus reducing the efficiency of the gutter.

SUMMARY OF THE INVENTION

It is the principal object of the present invention to provide an improvement in rain gutter endcaps that will capture runoff water falling from the shingles extending past the end of the fascia board.

In support of the principal object, another object of the present invention is to provide the improvement in rain gutter endcaps described above that is of minimum size and dimension such that the visual aesthetics of the roof line is only minimally distorted by the protrusion of a gutter endcap past the fascia board.

These and other objects and advantages of the present invention are accomplished through the use of an endcap having a rectangular bottom connected to a lower portion of the rain gutter at an end thereof proximal the end of the fascia board. The bottom does not extend past the end of the fascia board. A flared portion is integrally connected to the bottom and extends upwardly and longitudinally outwardly from the bottom beyond the end of the fascia board and past the longitudinal extension of the shingles such that runoff water flowing from the portion of the shingles extending past the fascia board is captured in the flared portion and thereafter flows to the bottom and into the rain gutter. A reinforced rim is integrally connected to an upper margin of the flared portion to support the structural integrity of the endcap.

BRIEF DESCRIPTION OF THE DRAWINGS

Apparatus embodying features of my invention are depicted in the accompanying drawings which form a portion of this disclosure and wherein.

DESCRIPTION OF A PREFERRED EMBODIMENT

Figure 1:
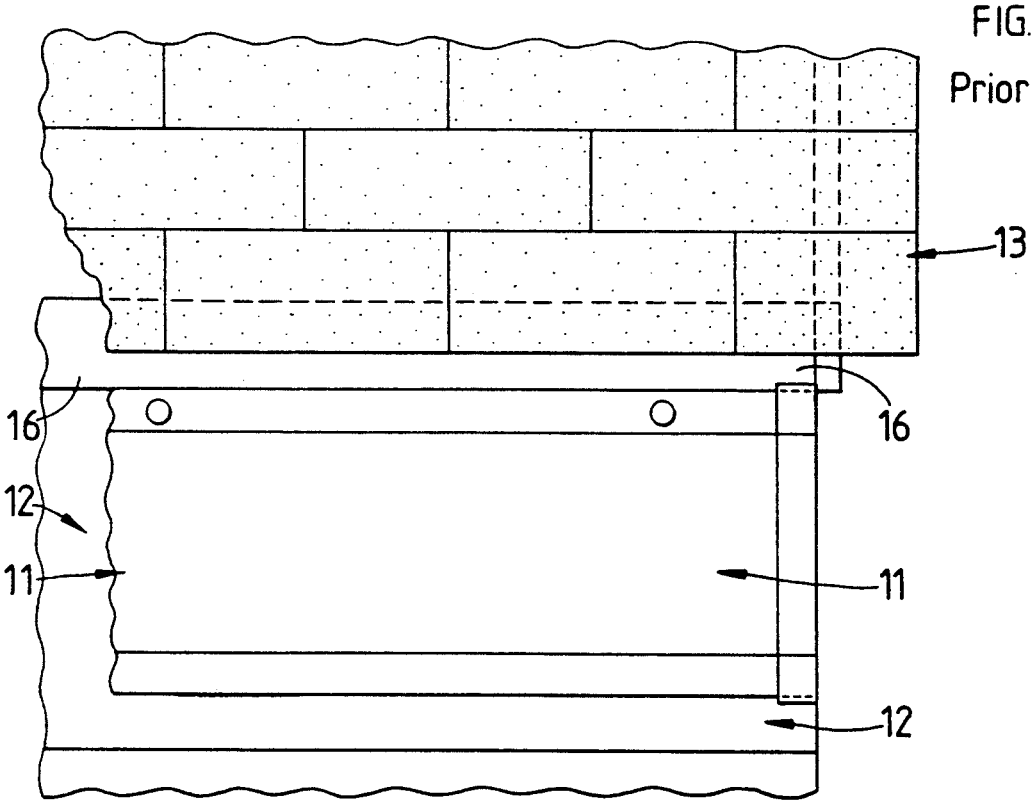
FIG. 1 Prior Art
FIG. 1 is a side elevational view of the prior art connected to a fascia board.
Figure 2:
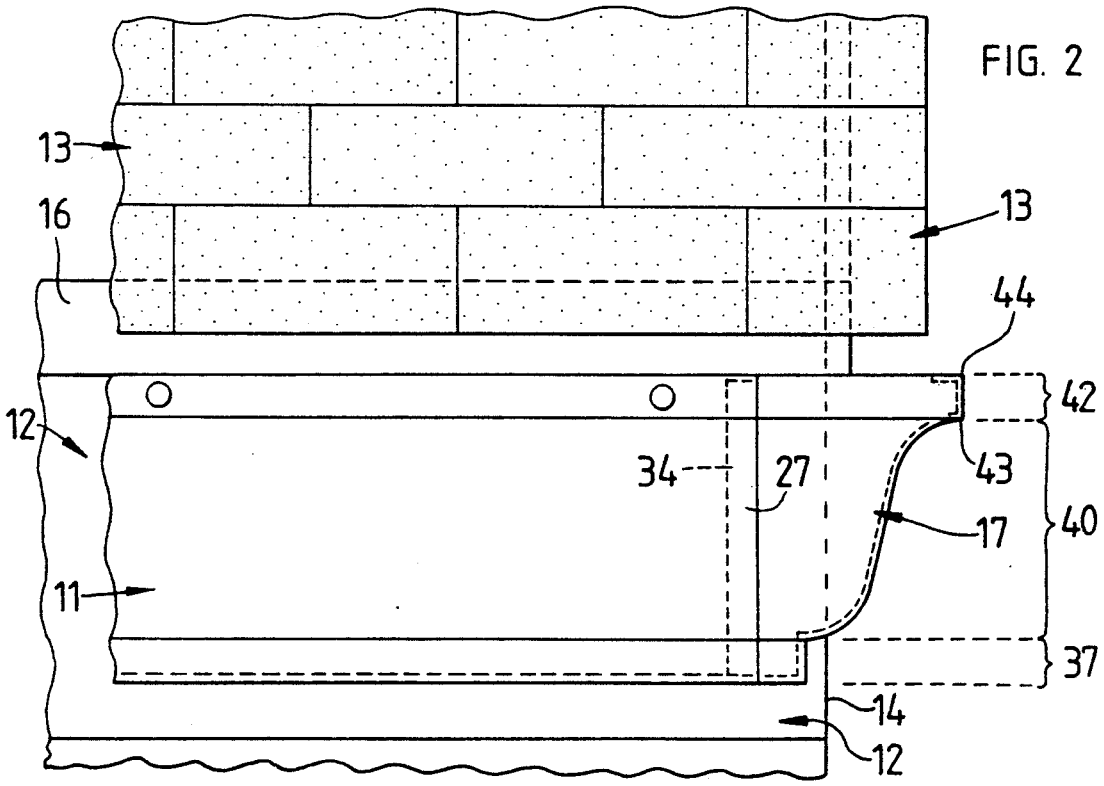
FIG. 2 is a side elevational view of the present invention connected to a fascia board.
Figure 3:
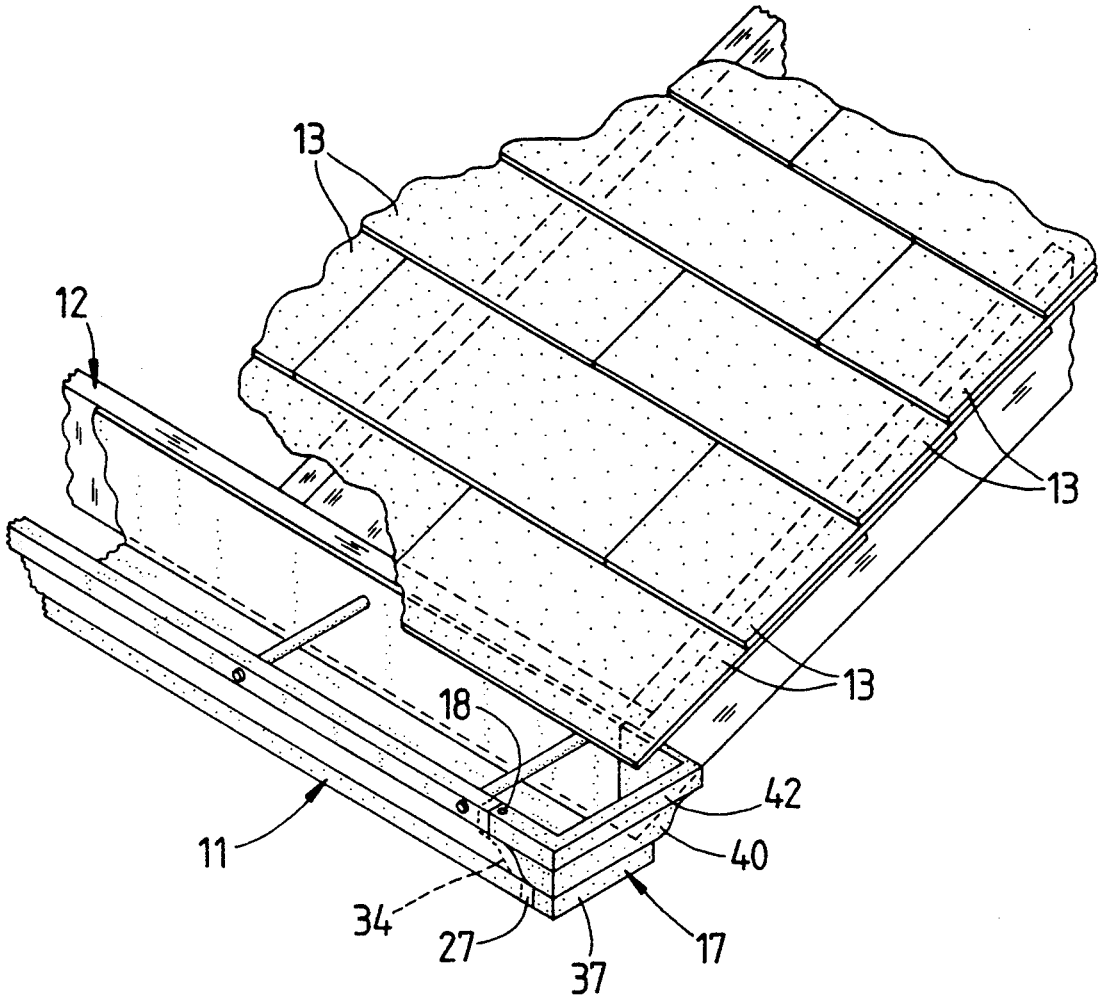
FIG. 3 is a perspective view, partially broken away showing the present invention connected to a fascia board.

Referring to the drawings for a clearer understanding of the invention, it should be noted in FIG. 2 that the present invention is used with a rain gutter 11 which is connected to a fascia board 12. The fascia board 12 defines a portion of a shingle support structure (not shown) to which a plurality of shingles 13 are connected. As shown in FIG. 3, the shingles 13 slope downwardly and extend laterally beyond the fascia board 12 and above the rain gutter 11. The shingles 13 also extend longitudinally beyond an end 14 of the fascia board 12. As shown in FIG. 2, a trim piece 16 may be connected to the fascia board 12 such that the shingles 13 extend laterally and longitudinally beyond the trim piece 16.

Figure 4:
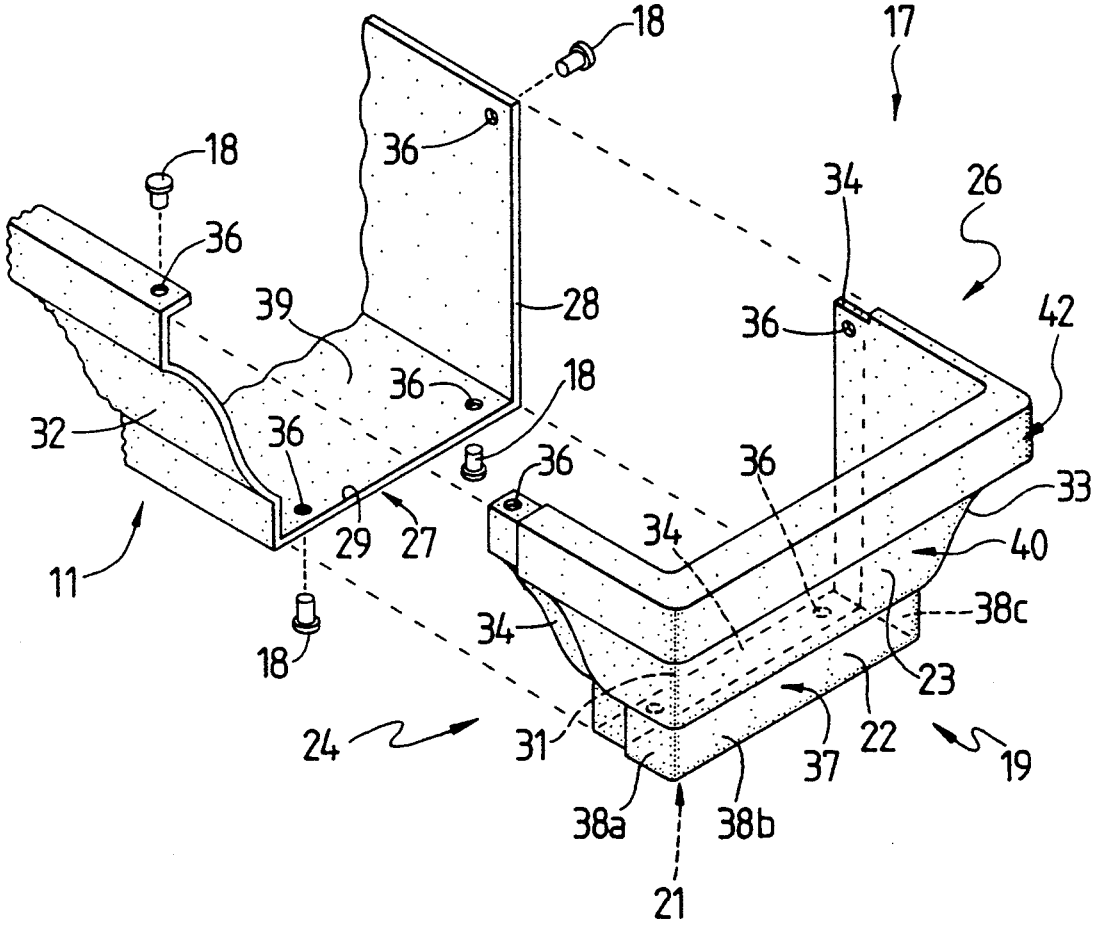
FIG. 4 is an exploded perspective view of the present invention and a rain gutter.
Figure 5:
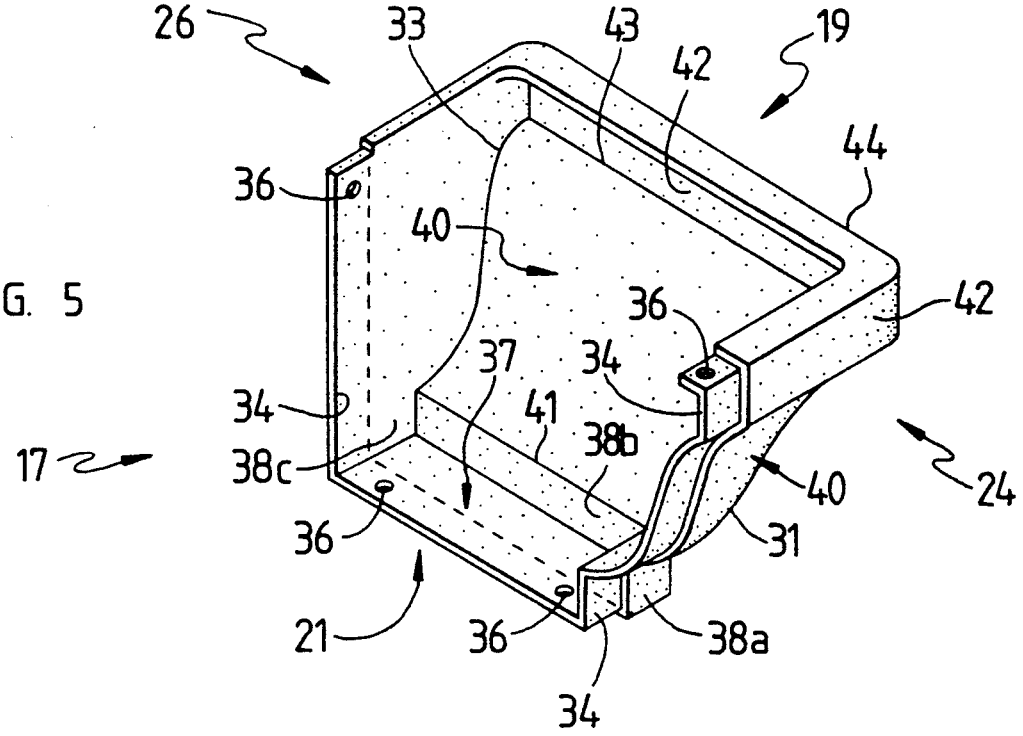
FIG. 5 is a perspective view of the present invention.
Figure 6:
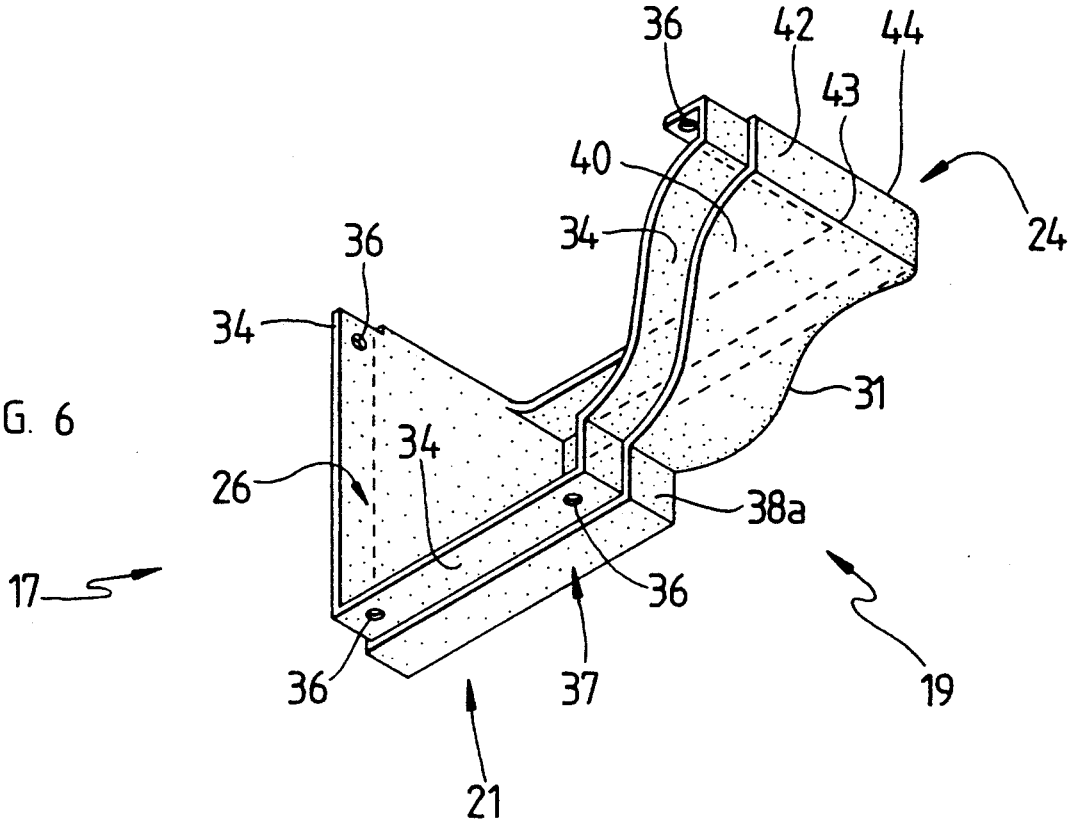
FIG. 6 is a perspective view of the present invention as seen from below FIG. 5.

As shown in FIG. 4, the present invention is an improved endcap 17 attached to the gutter 11 with fasteners 18. As shown in FIGS. 4–6, the endcap 17 includes an end wall 19 connected to a bottom 21 and having a power vertical face 22 and an upwardly and outwardly flared portion 23; a second wall 24 and a planar third wall 26. The gutter 11 defines a substantially U-shaped end 28 adjacent to which the endcap 17 is connected. The bottom 21 is attached to the rain gutter 11 adjacent a lower portion 29 of the U-shaped end 28. The end wall 19 extends upwardly from the bottom 21 and longitudinally from the rain gutter 11, beyond the end 14 of the fascia board 12 and past the longitudinal extension of the plurality of shingles 13 to capture runoff water falling from the shingles 13 extending longitudinally beyond the fascia board 12. The second wall 24 is integrally connected to the end wall first side 19. The second wall 24 is integrally attached to the bottom 21 and connected to the gutter 11 adjacent to the U-shaped end 28. The second wall 24 extends upwardly and outwardly from the bottom 21 in conformity with an outer side 32 of the gutter 11. The third wall 26 is integrally connected to a second lateral, the end wall 19 and to the bottom 21. The third wall is connected to the rain gutter 11 adjacent to the U-shaped end 28. The third wall 26 is planar and coextends the fascia board 12 in adjacent parallel planar relation thereto and in conformity with the rear side of the gutter.

The open end 34 of the endcap 17 is dimensionally reduced to fit snugly within the rain gutter 11 in cooperative relation to the substantially U-shaped end 28. The dimensionally reduced end 34 and gutter 11 thus overlap and are provided with corresponding holes 36 in which fasteners 18 are received to fasten the endcap 17 to the gutter 11. A funnel portion 40 is defined by flared portion 23 and second and third walls 24 and 26. The funnel portion flares upwardly and outwardly from the bottom 21 and beyond the longitudinal extension of the plurality of shingles 13. The portions of walls 19 and 24 forming the funnel portion 40 are curved to minimize splash and to maintain the aesthetic continuity of the gutter 11. A reinforced rim 42 is integrally connected to an upper edge 43 of the funnel portion 40 and partially defines an upper margin 44 of the endcap 17.

When connected to the gutter 11 as described above, the endcap 17 will capture runoff water (not shown) falling from the shingles 13 that extend longitudinally beyond the gutter 11 and fascia board 12. The upwardly flared shape of the end wall 23 is particularly suited for this purpose by minimizing the bulk of the endcap extending past the fascia board and thus maintaining the aesthetic continuity of the roof line. By minimizing the bulk of the endcap 17 and/or gutter 11, the chances of inadvertent damage thereto from wind, painter's ladders, etc. is also minimized. From the foregoing, it should be clear that the present article represents a substantial improvement over the prior art.

While I have shown my invention in one form, it will be obvious to those skilled in the art that it is not so limited but is susceptible of various changes and modifications without departing from the spirit thereof.

What I claim is:

1. A trough type rain gutter having a substantially vertical U-shape defining an end thereof, said rain gutter connected to a fascia board defining a lower portion of a shingle support structure said fascia board having an end, said shingle support structure having a plurality of shingles extending laterally beyond said lower portion and longitudinally beyond said end of said fascia board and said U-shaped end, the improvement comprising:

(a) a flat bottom mounted to a lower portion of said U-shaped end and extending horizontally therefrom adjacent to said end of said fascia board;

(b) a first end wall attached to said bottom opposite said U-shaped end and extending diagonally upwardly and outwardly from said bottom beyond said end of said fascia board and past said longitudinal extension of said plurality of shingles to capture runoff water falling from said plurality of shingles beyond said end of said fascia board;

(c) a second wall integrally connected to said first wall and to said bottom, said second wall extending within said rain gutter at said U-shaped end; and (d) a third wall integrally connected to said first end wall and to said bottom, said third wall extending within rain gutter adjacent to said U-shaped end.

2. An improvement in endcaps as defined in claim 1 further comprising a dimensionally reduced portion integrally formed by said bottom and said second and third walls and extending within said rain gutter in cooperative relation to said substantially U-shaped end.

3. An improvement in endcaps as defined in claim 2 further comprising means for fastening said endcap to said rain gutter.

4. An improvement in endcaps as defined in claim 1 wherein said first and second sides include a structurally reinforced rim defining an upper margin thereof.

5. A rain gutter having a substantially vertical U-shaped end, said rain gutter connected to a fascia board that defines a lower portion of a shingle support structure, said fascia board having an end, said shingle support structure having a plurality of shingles extending laterally beyond said fascia board and over said rain gutter and said plurality of shingles extending longitudinally beyond said end of said fascia board and said U-shaped end of said rain gutter, the improvement comprising an endcap connected to said U-shaped end and extending diagonally upwardly and longitudinally from a lower portion of said U-shaped end of said rain gutter beyond said end of said fascia board and beyond said plurality of shingles extending longitudinally beyond said end of said fascia board, such that runoff water falling from said shingles extending longitudinally beyond said end of said fascia board will fall within said endcap and flow into said rain gutter.

6. An improvement in endcaps as defined in claim 5 wherein said endcap comprises:

(a) a rectilinear bottom;

(b) a funnel portion integrally connected to said bottom and extending upwardly therefrom and longitudinally from said rain gutter beyond said longitudinal extension of said plurality of shingles; and (c) a reinforced rim integrally connected to an upper edge of said funnel portion and partially defining an upper margin of said endcap.

7. An improvement in endcaps as defined in claim 6 wherein said funnel portion includes a planar vertical side of said endcap extending in adjacent parallel planar relation to said fascia board.

8. An improvement in endcaps as defined in claim 7 further comprising a dimensionally reduced portion integrally connected to said bottom end, said funnel portion extending from said rain gutter in cooperative relation to said U-shaped end.

* * * * *